US010349180B2

(12) United States Patent
Sumitani et al.

(10) Patent No.: US 10,349,180 B2
(45) Date of Patent: Jul. 9, 2019

(54) SHALLOW SUB WOOFER

(71) Applicant: SOUND SOURCES TECHNOLOGY, INC., Torrance, CA (US)

(72) Inventors: Yoichiro Sumitani, Rancho Palos Verdes, CA (US); Ching-Huang Cheng, New Taipei (TW); Chih-Huang Hsiao, New Taipei (TW)

(73) Assignee: Sound Sources Technology, Inc., Torrance, CA (US)

( * ) Notice: Subject to any disclaimer, the term of this patent is extended or adjusted under 35 U.S.C. 154(b) by 0 days.

(21) Appl. No.: 15/397,400

(22) Filed: Jan. 3, 2017

(65) Prior Publication Data

US 2018/0192201 A1 Jul. 5, 2018

(51) Int. Cl.

| | |
|---|---|
| ***H04R 9/06*** | (2006.01) |
| ***H04R 9/04*** | (2006.01) |
| ***H04R 31/00*** | (2006.01) |
| *H04R 1/06* | (2006.01) |

(52) U.S. Cl.

CPC ..... *H04R 9/06* (2013.01); *H04R 9/045* (2013.01); *H04R 31/006* (2013.01); *H04R 1/06* (2013.01)

(58) Field of Classification Search

CPC ..... H04R 9/06; H04R 9/043; H04R 9/045; H04R 1/06; H04R 7/127; H04R 7/18; H04R 9/046; H04R 9/04; H04R 9/041; H04R 31/006; H04R 31/003

See application file for complete search history.

(56) References Cited

U.S. PATENT DOCUMENTS

| | | | | |
|---|---|---|---|---|
| 3,404,053 | A | 10/1968 | Tokuma et al. | |
| 4,566,178 | A | 1/1986 | Hecht et al. | |
| 5,583,944 | A * | 12/1996 | Morohoshi | H04R 1/06 381/400 |
| 5,625,701 | A | 4/1997 | Scanlan | |
| 5,734,132 | A | 3/1998 | Proni | |
| 6,088,466 | A * | 7/2000 | Proni | H04R 9/02 381/397 |
| 6,817,084 | B2 | 11/2004 | Tokusho et al. | |
| 7,324,659 | B2 | 1/2008 | Funahashi et al. | |
| 7,356,157 | B2 * | 4/2008 | Proni | H04R 1/06 381/394 |
| 7,433,485 | B1 * | 10/2008 | Diedrich | H04R 9/06 381/404 |
| 7,502,487 | B2 | 3/2009 | Watanabe | |
| 7,515,727 | B2 | 4/2009 | Watanabe | |

(Continued)

FOREIGN PATENT DOCUMENTS

KR 101169381 8/2012

*Primary Examiner* — MD S Elahee
*Assistant Examiner* — Angelica M McKinney
(74) *Attorney, Agent, or Firm* — Stetina Brunda Garred & Brucker

(57) ABSTRACT

A shallow speaker and a method of manufacture for the shallow speaker. The method of assembly uses two different alignment jigs at two different stages of the assembly to ensure alignment of the speaker components. During manufacture, a subassembly of components is created in the speaker frame, and then removed along with the first alignment jig. A second alignment jig is then placed in the speaker, and the bobbin and voice coil added. The subassembly is then connected to the frame, and the voice coil connected to the external connection terminal. Finally, the cone and dust cap are installed.

7 Claims, 10 Drawing Sheets

(56) References Cited

U.S. PATENT DOCUMENTS

| | | | | |
|---|---|---|---|---|
| 7,792,320 | B2 | 9/2010 | Proni | |
| 9,008,348 | B1 | 4/2015 | Kallen et al. | |
| 9,025,809 | B1 | 5/2015 | Kallen et al. | |
| 9,066,179 | B2 | 6/2015 | Burleson et al. | |
| 2006/0171555 | A1* | 8/2006 | Brandt ..... | H04R 1/06<br>381/396 |
| 2016/0088413 | A1 | 3/2016 | Wang et al. | |
| 2016/0142803 | A1 | 5/2016 | Ara et al. | |

* cited by examiner

SHALLOW SUB WOOFER

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention relates generally to loudspeaker devices, and more particularly, to shallow subwoofer speakers and methods for manufacturing the same.

Speakers meant for full spectrum reproduction face the difficulty of trying to simultaneous reproduce high frequency, mid, and low frequency sound. Speaker cone design is limited in its ability to reproduce across all bands simultaneously. One solution is to use two or three separate speakers to cover the different bandwidths. In two speaker systems, the main speakers sound cleaner and louder when not forcing it to do extra work in the low-frequency range. With the low frequencies sourced to a purpose built speaker, the system can reproduce the full audio spectrum with better clarity.

However, one clear drawback is that as speakers are added to the system for a specific purpose, the footprint of the system increases. The size of the overall system and each component may be limiting factors in the marketability of a speaker system. Specifically, in terms of subwoofers, the speaker drivers are often placed in a box in order to cancel frequencies emanating from the rear of the speaker, so that a better response from the front of the speaker may be achieved. If the driver design is relatively deep, the box must be correspondingly deep, leading to a large footprint. In residential and automotive settings, the footprint of the box can limit the marketability of the speaker driver. Thus, in general, it is better to limit the depth of the speaker driver.

In addition, most speakers have the cone connected directly to the voice coil. As the voice coil moves, so does the speaker cone. However, in this configuration, the movement of the cone is controlled solely from the attachment point at the voice coil.

BRIEF SUMMARY

The present disclosure is directed to a method for manufacture of a shallow speaker, a system for aligning speaker components during assembly of the speaker, and an embodiment of a shallow speaker. According to one method of manufacture, the method may include providing a speaker frame. The speaker frame may include an exterior, an interior, a rear wall, and an external connection terminal. The external connection terminal may include external connection terminal lead wires, and the external connection terminal may be mounted on the exterior of the speaker frame. The method may further include attaching a speaker motor to the speaker frame rear wall in the interior of the frame. The speaker motor may include a front plate and a pole piece. The front plate may include an exterior circumference. The method may further include providing a first alignment jig. The first alignment jig may include an annular support leg and a perimeter flange located circumferentially about the annular support leg. The method may further include aligning the first alignment jig on the speaker motor by placing the annular support leg around the front plate exterior circumference. The method may further include placing an assembly in the speaker frame interior. The assembly may include an edge support, a spider and pins, with each pin possibly including a first end and a second end. The placement of the assembly may be controlled by an abutment of the first alignment jig perimeter flange and the edge support. The method may further include attaching a voice coil support to the edge support. The voice coil support may include a central opening, and the central opening may define a central opening interior circumference. The method may further include removing the assembly and attached voice coil support from the speaker frame interior, as well as removing the first alignment jig from the speaker motor. The method may further include providing a second alignment jig. The second alignment jig may include an exterior surface. The method may further include providing a bobbin. The bobbin may include an outer surface and a bore, and have a voice coil wound around the outer surface, and the voice coil may include voice coil lead wires. The method may further include placing a second alignment jig in the bore of the bobbin. The method may further include attaching the bobbin to the pole piece. The method may further include attaching the assembly and attached voice coil support to the frame. During the attachment, the alignment of the assembly and attached voice coil support may be controlled by the abutment of the central opening interior circumference and second alignment jig exterior surface. The method may further include removing the second alignment jig from the bore. Further, the method may further include attaching each voice coil lead wire to a first end of a corresponding pin, and attaching each external connection terminal lead wire from the external connection terminal to a second end of a corresponding pin. Additionally, the method may further include attaching a cone to the voice coil support and edge support, and may include attaching a dust cap to the cone.

Further disclosed is a system for aligning speaker components during the assembly of the speaker components. The speaker components may include a frame, a motor, an edge support, a spider, a bobbin, a voice coil, and a voice coil support. The frame may include an open end, and the open end may define a speaker front. The motor may include a front plate and a pole piece. The pole piece may define a speaker central axis. The voice coil support may include a central opening, and the voice coil may include a plurality of lead wires. The bobbin may include an inside dimension. The system may include a first alignment jig. The first alignment jig may include a base, and the base may include a first surface, a second surface opposite the first surface, an annular support leg and a perimeter flange circumferentially about the annular support leg. The perimeter flange may abut the edge support, and the abutment may align the edge support during assembly of the speaker. The annular support leg may abut the front plate and may align the first alignment jig to the pole piece during assembly. A central extension may extend from the first surface toward the speaker front, and the central extension may abut the voice coil support central opening and may align the voice coil support with the pole piece during assembly. The system may further include a second alignment jig. The second alignment jig may include an outer surface, a substantially cylindrical body with an outside dimension less than the bobbin inside dimension, and at least one lead wire retention element on the substantially cylindrical body. The at least one lead wire retention element may be configured to engage the plurality of voice coil lead wires and may abut a portion of the lead wires from the end of the voice coil to the at least one lead wire retention element to the second alignment jig outer surface.

Further disclosed is an embodiment of a shallow speaker. The shallow speaker may include a speaker frame defining an interior, the speaker may include an external connection terminal, a lower flange, and an upper flange. The external connection terminal may include a plurality of external connection terminal lead wires. The shallow speaker may further include a speaker motor in the interior of the speaker frame, and the speaker motor may include a pole piece, a bobbin abutting the pole piece, and a voice coil located around the bobbin. The voice coil may include a plurality of voice coil lead wires. The shallow speaker may further include a spider, and the spider may include an inside edge and an outside edge, the outside edge may be attached to the lower flange of the speaker frame, an edge support may attach to the upper flange of the frame and may attach to the inside edge of the spider. A voice coil support may attach to the edge support and the bobbin, and the voice coil support may include channels, each channel may be sized and configured to accommodate one of the plurality of voice coil lead wires. The shallow speaker may further include a plurality of pins, and a portion of each one of the plurality of pins may be located between the voice coil support and the edge support. Each pin may include a vertical element and a horizontal element, a first end may be located on the vertical element, and a second end may be located on the horizontal element. Each one of the plurality of voice coil lead wires may be attached to a corresponding first end of one of the plurality of pins, and each one of the plurality of external connection terminal lead wires may be attached to a corresponding second end of one of the plurality of pins. The shallow speaker may further include a cone connected to the voice coil support, and a dust cap connected to the cone.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Speaker design and manufacture presents several problems. First, speakers are often used in environments where space is at a premium. For example, the speakers may be installed in automobile doors or elsewhere within the interior of the automobile. Or, the speakers might be installed in speaker cabinets which are used in the interior of a building. Space might also be at a premium here. Space constraints may be driven by limited space in the room in which the speaker cabinet is placed, and those space constraints may require a speaker cabinet with a smaller form factor. The smaller form factor, may, in turn, cause space constraints within the speaker cabinet itself.

Even if the space constraints may be designed around, there are still inherent problems with the manufacture of speakers. Specifically, several layers of components need to be aligned to a central axis. Misaligned components can lead to poor speaker performance and undesirable side effects, including operation of the speaker causing the speaker to damage itself. A manufacturing process which can ensure alignment of components means higher quality of each speaker manufactured, conceivably enhancing brand due to the consistent high quality, and less waste, both in quality control or assurance and returns.

For this disclosure, exterior is defined as being on or closer to the outer circumference of the speaker, and interior is defined as being radially at or closer to, the center of the speaker as defined by a speaker central axis. Front is defined as the portion of the speaker corresponding to an opening of a speaker frame, and the rear as corresponding to the portion of the frame opposite the front.

Figure 1:
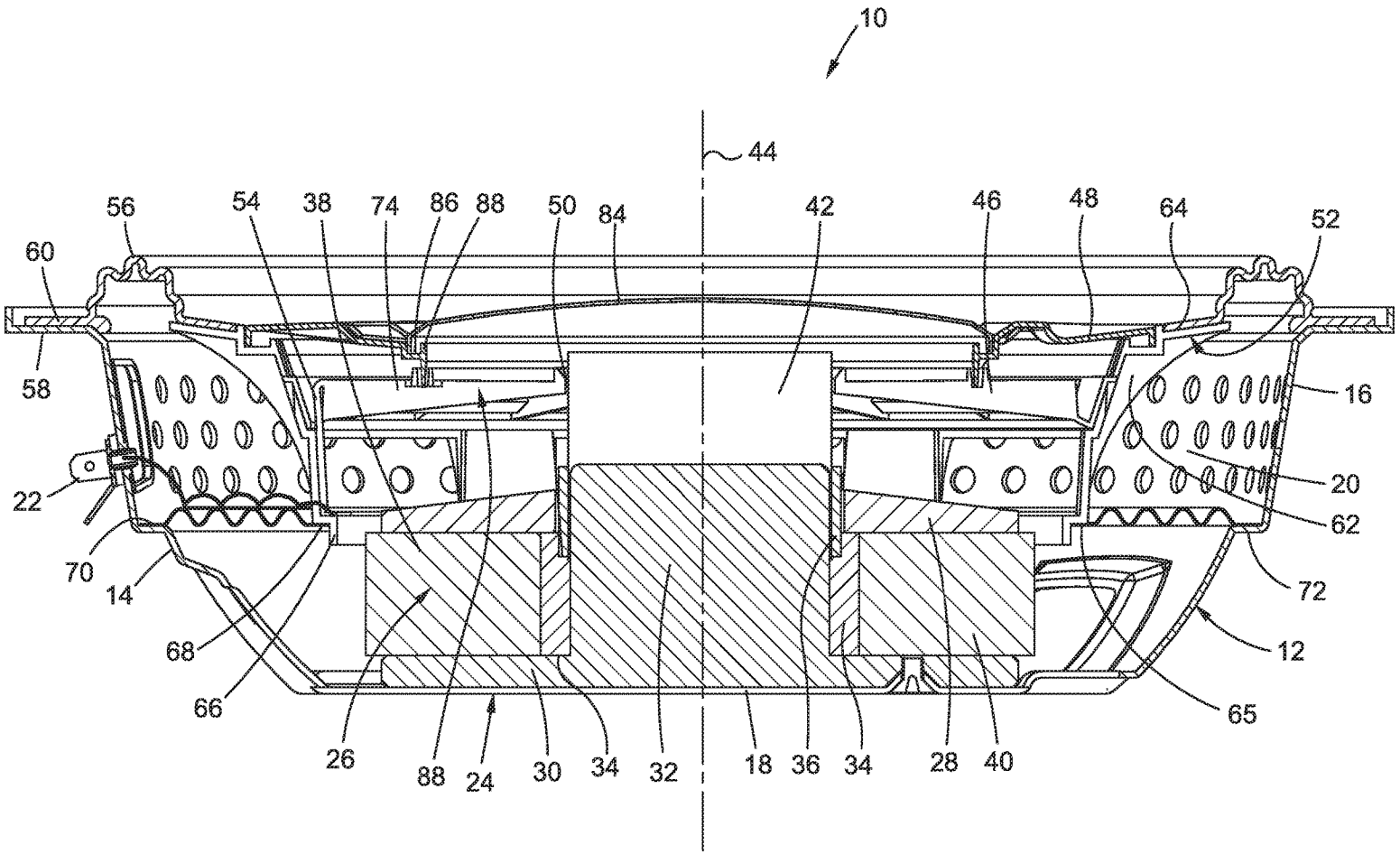
FIG. 1 shows a side cross section of the assembled speaker.
Figure 2:
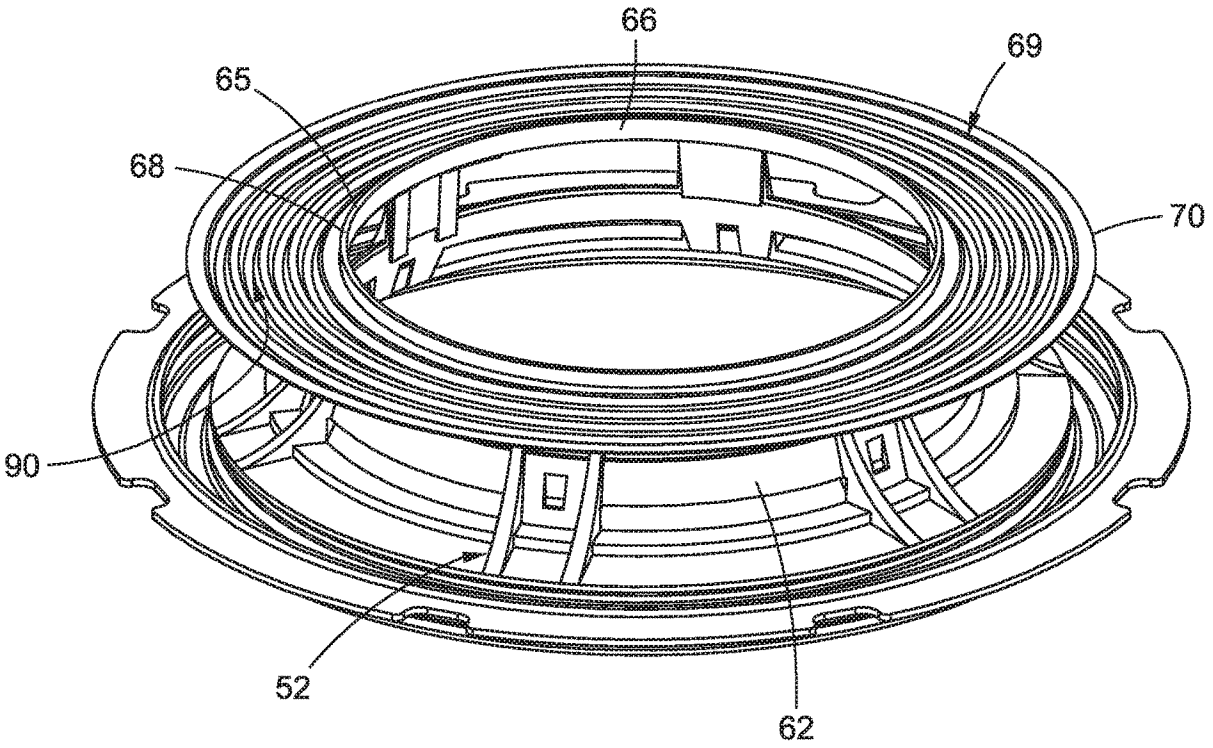
FIG. 2 is a perspective view of the assembled spider and edge support.

As shown in FIG. 1, the speaker 10 may include a speaker frame 12, also simply referred to as a frame, including an exterior surface 14, also referred to as an exterior, a side wall 16, and a rear wall 18. The speaker frame 12 defines an interior 20. An external connection terminal 22 may be mounted on the exterior 14 of the speaker frame 12. The speaker 10 may include a motor 24 mounted to the rear wall 18 of the frame 12 in the interior 20. The motor 24 may include a magnet 26, a front plate 28, a rear plate 30, a pole piece 32, and define a gap 34. The gap 34 may be the area around the pole piece 32 between the pole piece 32 and the magnet 26. A voice coil 36 may fit into the gap 34. A bobbin 42 which may be attached to the pole piece 32. The pole piece 32 longitudinal axis and the speaker central axis 44 are co-axial.

The bobbin 42 may be attached to a voice coil support 46, and not directly to a cone 48, at a central opening 50 of the voice coil support 46. The voice coil support 46 may be, in turn, attached to an edge support 52 around an outer perimeter 54 of the voice coil support 46.

The edge support 52 may include a ring 56 which attaches to an upper ledge 58 of the frame 12 along an outer perimeter 60 of the ring 56. The ring 56 may also attach to a rigid frame 62 of the edge support 52 along an inner perimeter 64 of the ring 56. The ring 56 may be made of a pliable material such that would allow the rigid frame 62, and other components attached to the rigid frame 62, to move in and out or back and forth, but provide resistance to side to side movement of the rigid frame 62 and any components attached to the rigid frame 62. An outer surface 64 of a rear aperture 66 of the rigid frame 62 may attach to a spider inner circumference 68. The rigid frame 62 may be made of a lightweight but rigid material, for example a plastic, aluminum, or carbon fiber.

The speaker may also include a spider 69. A spider outer circumference 70 may attach to a lower ledge 72 of the frame 12. One of a plurality of voice coil lead wire 74 may run from the voice coil 36 through the voice coil support 46 and to one of a plurality of pins 76, each of which may be attached to the edge support 52, and each of which may have a portion thereof located between the voice coil support 46 and the rigid frame 62. From a horizontal element 78 of each of the plurality of pins 76, each of a plurality of external connection terminal lead wires 80 may extend to the external connection terminal 22. The spider 69 allows the other speaker structures, specifically the voice coil 36 and the bobbin 42, to move in and out as the voice coil 36 is driven by the motor 24, but to resist movement from side to side. Control of the movement of the speaker 10 is essential, because without controlling the unwanted side to side movement, a speaker 10, simply by operating, could damage itself due to the uncontrolled vibration.

The cone 48 may attach to the rigid frame 62 and to the voice coil support 46 on a front side 82 of the both the rigid frame 62 and the voice coil support 46. A dust cap 84 attaches to the cone 48 on the front side of the cone 48. A dust cap edge 86 may rest in an inner perimeter channel 88 of the cone 48.

The plurality of external connection terminal lead wires 80 may run from the external connector terminal 22 on the exterior 14 of the frame 12, one lead wire 80 to a corresponding one of the plurality of pins 76. The pins 76 may be attached to the rigid frame 62. The pins 76 may be attached, for example, by an adhesive or a mechanical fastener, such as a nut and bolt combination or a screw. The plurality of voice coil lead wires 74 from the voice coil 36 may extend from the bobbin 42, through unobstructed channels 88 in the voice coil support 46, to attach to one of the plurality of pins 76. With this arrangement, an electrical signal may be passed from the external connector terminal 22 to the voice coil 36.

In order to manufacture the speaker, as is shown in FIGS. 2-9, the spider 69, including the outer circumference 70 and the inner circumference 68 with ridges 90 in between, may be attached to the rigid frame 62 of the edge support 52 at the exterior surface 65 of the rear aperture 66 of the rigid frame. The spider 69 may be attached to the rigid frame 62 using an adhesive, or may be attached through mechanical means, for example, by staples.

Figure 3A:
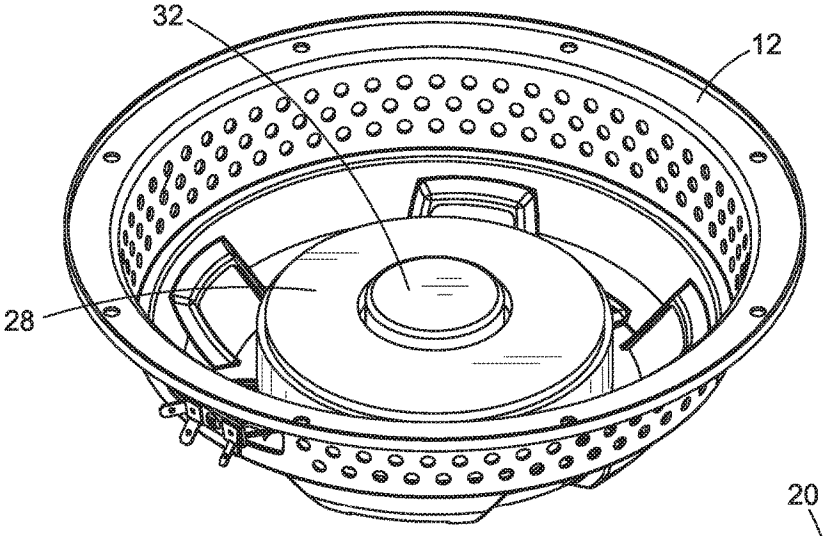
FIG. 3A is a perspective view of the frame and motor sub assembly.
Figure 3B:
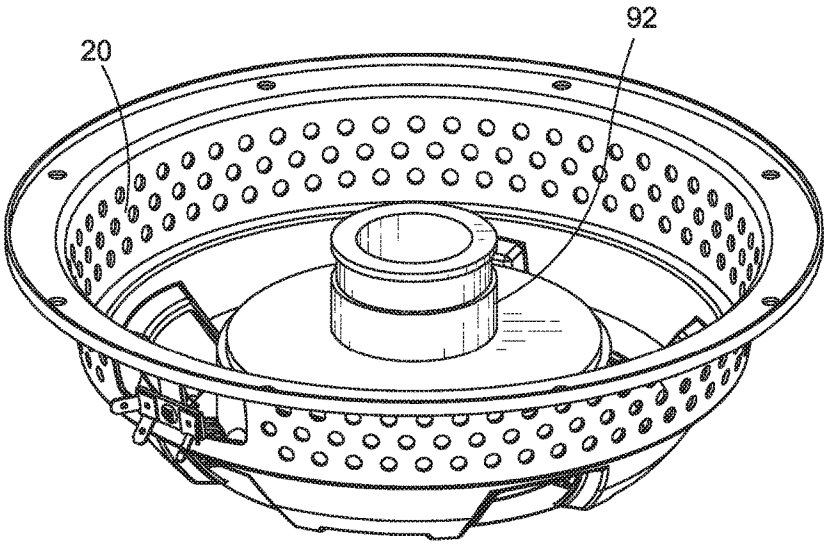
FIG. 3B is a perspective view of the frame and motor sub assembly with the first alignment jig installed.
Figure 3C:
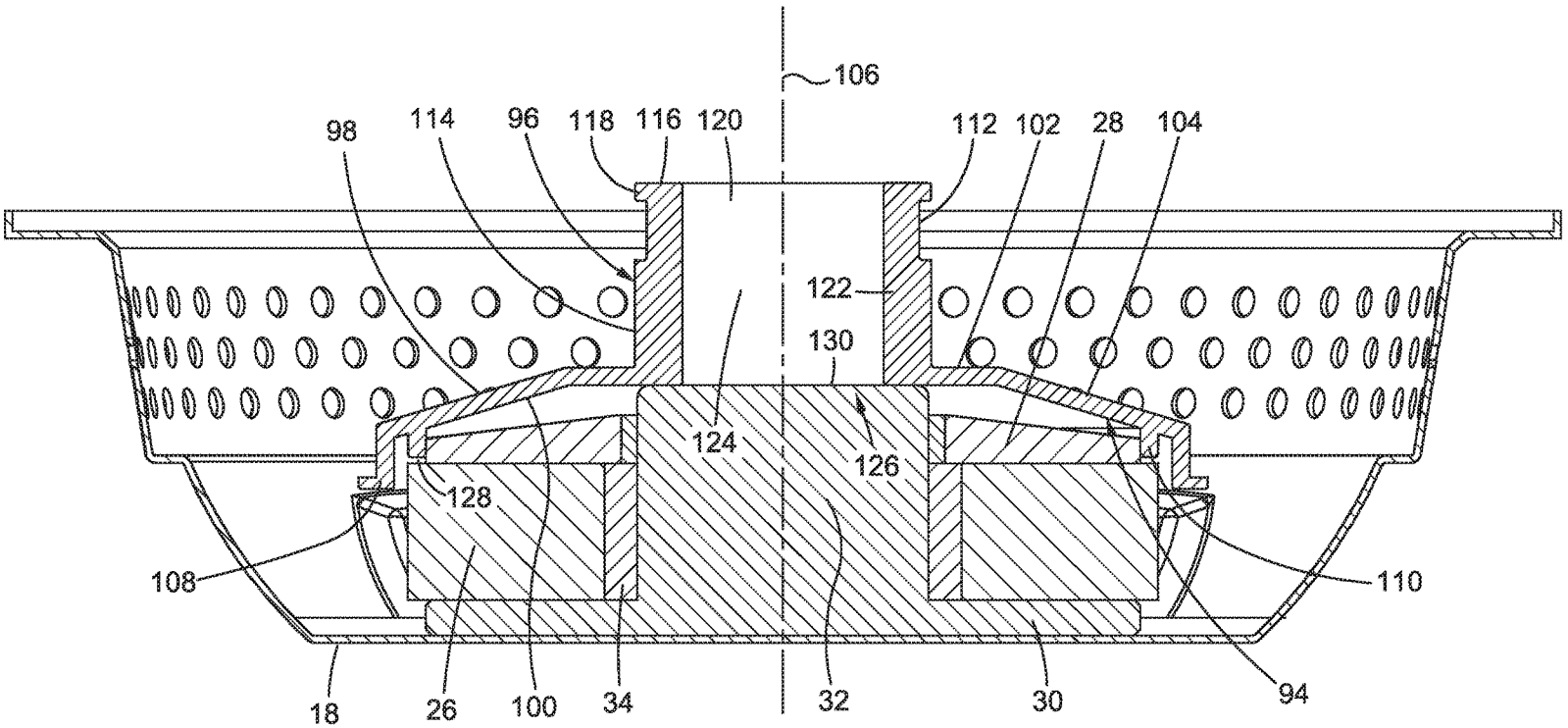
FIG. 3C is a side cross section view of the assembly in FIG. 3B.

As shown in FIGS. 3A-C, a step which may be done in parallel with the step of attaching the spider 69 to the edge support 52, the magnet 26, front plate 28, rear plate 30, and pole piece 32 may be attached to the frame 12. The magnet 26, front plate 28, rear plate 30, and pole piece 32 may be attached to a rear wall 18 of the frame 12 in the interior 20 of the frame 12. The relative locations of the magnet 26 and pole piece 32 define the gap 34. A first alignment jig 92 may then be placed on the sub assembly of frame 12, front plate 28, magnet 26, rear plate 30 and pole piece 32. The first alignment jig 92 may include a base 94 and a central extension 96. The base 94 may have a first surface 98 and a second surface 100. The base 94 may further have an interior portion 102 and exterior portion 104. The interior portion 102 may be orthogonal to a central axis 106 of the first alignment jig 92, which may be coaxial with, or, alternatively, parallel to, the speaker central axis 44. The exterior portion 104 may be angled toward the rear of the speaker 10 (FIG. 1), defining an acute angle between the rear wall 18 of the frame 12 and a radial extension of the interior portion 102. The exterior portion 104 may terminate with a perimeter flange 108 around an outer circumference of the exterior portion. The perimeter flange may be located circumferentially about an annular support leg 110, and the annular support leg 110 may extend from the second surface 100 of the first alignment jig 92.

The central extension 96 may be located to the interior of the interior portion 102 of the base 94, and may extend orthogonally to the interior portion 102 of the base 94. The central extension 96 may be substantially cylindrical in shape. The central extension 96 may include an annular groove 112 on an outer surface 114 of the central extension 96. The central extension 96 may terminate at a front end 116 with an annular lip 118. The front end 116 of the central extension 96 may include an opening 120. A wall 122 of the central extension may include a bore 124 that extends from the front 116 to a rear 126 of the central extension 96.

With specific reference to FIG. 3C, the first alignment jig 92 may be placed such that the annular support leg 110 is outside an outer diameter of the front plate 28. Thus, an interior diameter of the annular support leg 110 may be greater than an outer diameter of the front plate 28. An end face 128 of the annular support leg 110 may abut the magnet 26. Alternatively, or, in addition, an end face 130 of the pole piece 32 may abut the second surface of the first alignment jig substantially coaxially with the pole piece. The annular support leg 110 ensures that the first alignment jig 92 is aligned with, or at least parallel to, the speaker central axis 44 (FIG. 1).

Figure 4A:
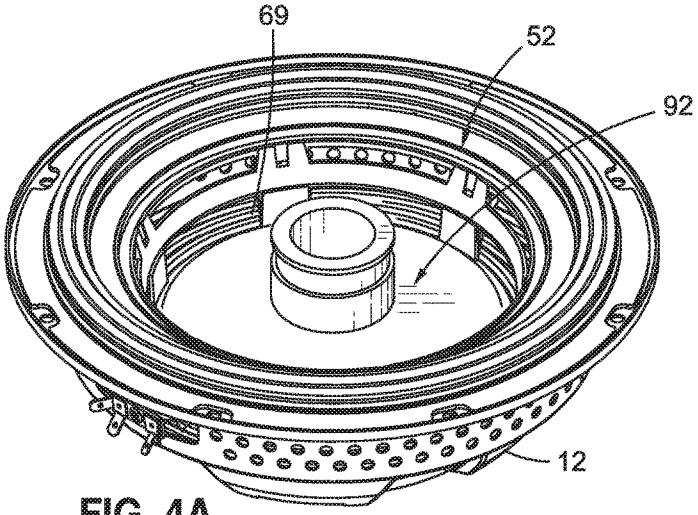
FIG. 4A is a perspective view of the subassembly of FIG. 3B with the edge support and spider sub assembly installed.
Figure 4B:
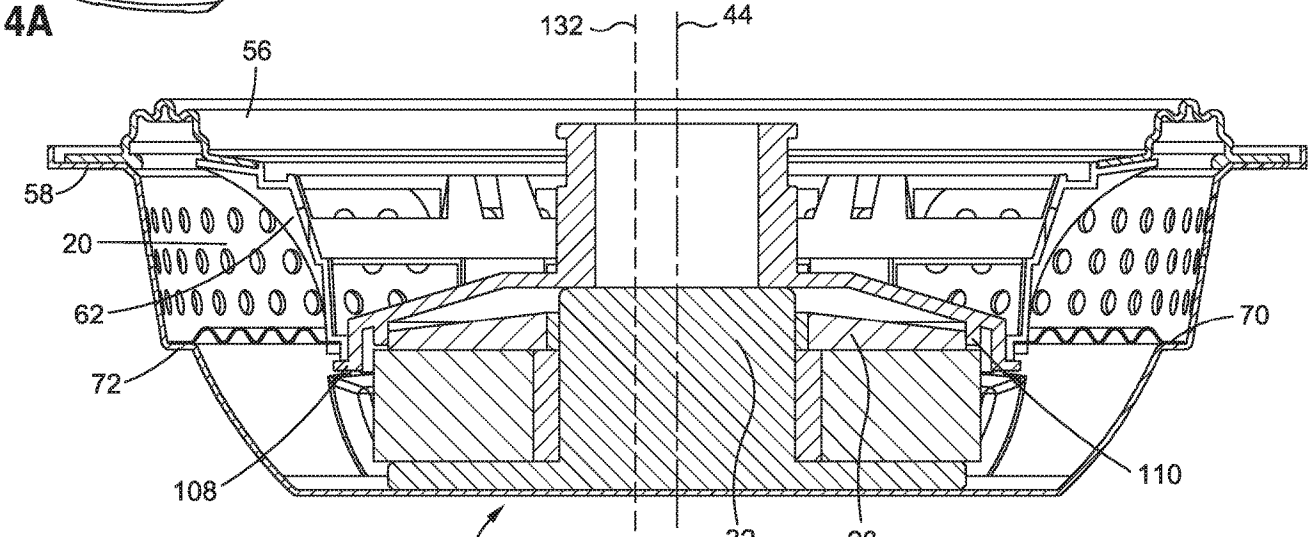
FIG. 4B is a side cross section view of FIG. 4A.

As shown in FIGS. 4A and 4B, the assembled edge support 52 and spider 69 may then be placed in the interior 20 of the frame 12. The edge support 52, and specifically, the ring 56, may rest on the upper ledge 58 of the frame 12, and the rigid frame 62 on the perimeter flange 108 of the first alignment jig 92. The spider outer circumference 70 may rest on the lower ledge 72 of the frame 12. The alignment of the edge support 52 may be controlled by the engagement or abutment between the rigid frame 62 and the perimeter flange 108 of the first alignment jig 92. In this way, the first alignment jig 92 may align the edge support 52 with the motor 24 because the first alignment jig 92 is in contact with at least both the front plate 28 through the annular support leg 110 and the rigid frame 62 through the perimeter flange 108. The first alignment jig 92 aligns the components so that they are arranged concentrically to the pole piece longitudinal axis 44. Even if, for example, the mounting of the motor 24 to the frame 12 is such that the motor 24 is off axis from a frame central axis 132, the function of the first alignment jig 92 is unaffected by such a misalignment because the first alignment jig 92 functions to align subsequently installed components, such as the spider 69 and edge support 52 to the motor 24, which is aligned around the pole piece 32.

Figure 5A:
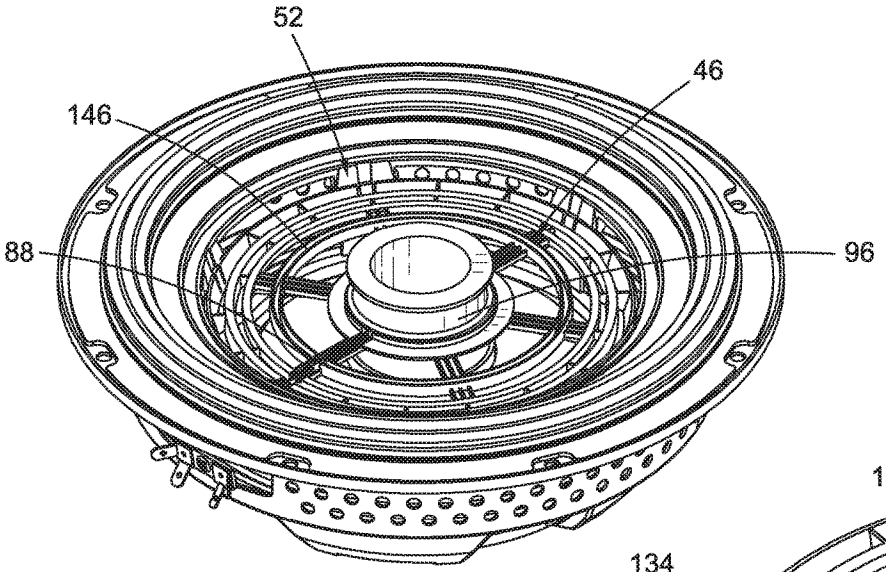
FIG. 5A is perspective view of the voice coil added to the assembly of FIG. 4B.
Figure 5B:
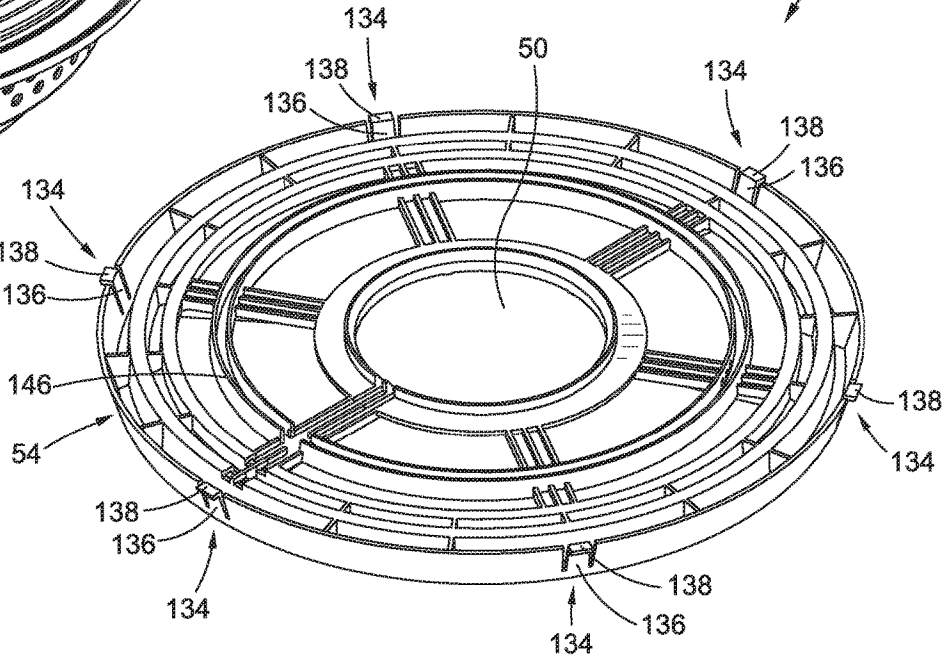
FIG. 5B is a perspective view of the voice coil support.
Figure 5D:
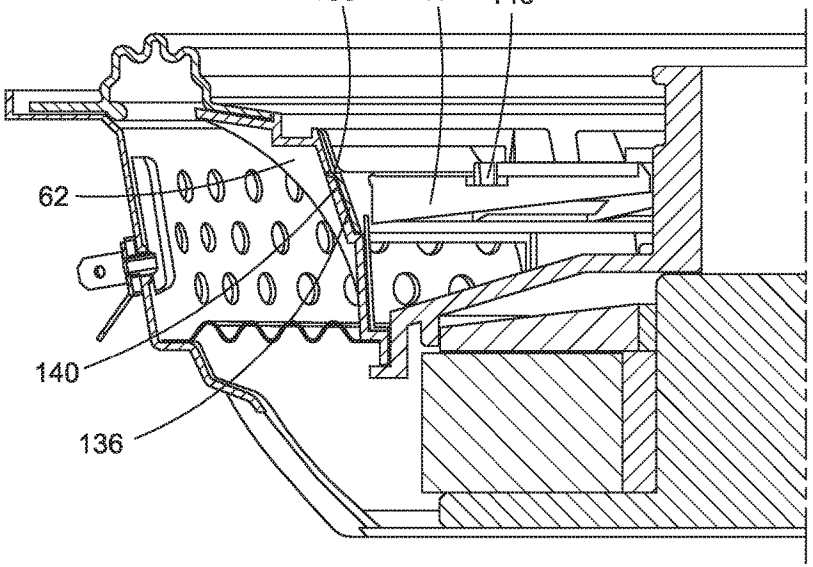
FIG. 5D is a detail view of the position of a pin between the edge support and the voice coil support.
Figure 5C:
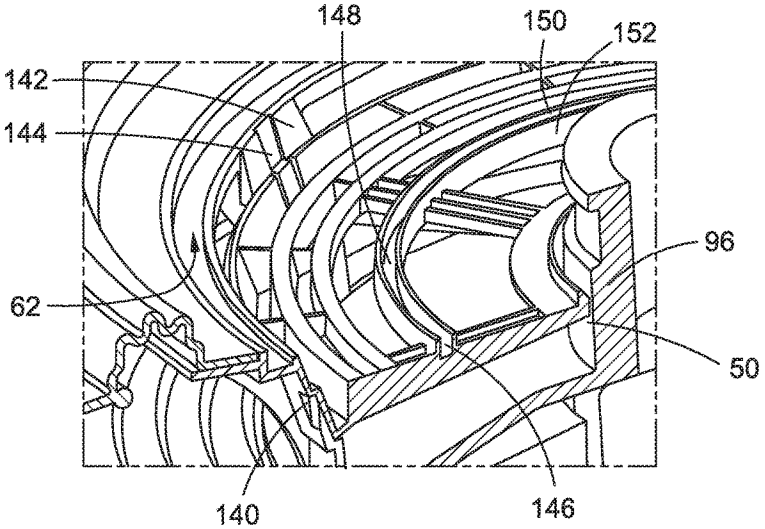
FIG. 5C is a detail view of a detent connection between the edge support and the voice coil support.

FIGS. 5A-5D shows a further step in the manufacture of the speaker 10 (FIG. 1). This step includes the connection of the voice coil support 46 to the edge support 52. The voice coil support 46 and edge support 52 may include multiple corresponding detent elements, with the voice coil support detent elements 134 being placed on an outer perimeter 54 of the voice coil support 46. For example, as shown in FIG. 5A, the detent elements 134 may be male detent elements with each element 134 including a leg 136 and a boss 138 on the voice coil support 46. As shown in FIG. 5C, the edge support 52 may include corresponding detent elements 140, for example, slots sized and shaped to receive the boss 138, in the edge support 52. Alternatively, the location of the detent elements may be reversed such that the male detent elements 134 are on the edge support 52 and the female detent elements 140 are one the voice coil support 46. The voice coil support 46 may be placed in the edge support 52 from the front of the speaker 10 (FIG. 1). Linear elements 142 of the rigid frame 62, on which the slots 140 are located, are angled radially inward from front to rear of the edge support 52. This arrangement of the linear elements 142 allows the voice coil support 46 to be moved in to place without any initial contact, and then, as the voice coil support 46 is moved toward the rear of the edge support 52, to come in to contact with the edge support. The contact between the linear elements 142 and the boss 138 of each detent element 134 causes the leg 136 of each male detent element 134 to be pushed backward. The leg 136 biases the boss 138 against the linear element 142, and then in to the slot 140. The movement of the boss 138 in to the slot 140 does not fully release the bias of the leg 136. The remaining bias helps ensure that each boss 138 remains secure in the corresponding slot 140. Additionally, linear elements 142 may include channels 144 which are shaped and located to direct bosses 138 to the slots 140.

The voice coil support 46 may include an annular channel 146 for attaching the cone 48 to the voice coil support 46. The annular channel 146 may include a bottom 148 and two opposed, parallel side walls 150, 152 on either side of the bottom 148. The annular channel 146 may be obstructed by unobstructed channels 88 which are sized and configured to accommodate a plurality of voice coil lead wires 74 (FIG. 1). The unobstructed channels 88 run radially from the central opening 50 of the voice coil support 46 to the outer perimeter 54 of the voice coil support 46. The central opening 50 is sized and shaped to allow the bobbin 42 (FIG. 1) to extend through after the speaker 10 (FIG. 1) is assembled. The central extension 96 is sized and shaped to simulate the bobbin 42 during assembly, and the central extension 96 abuts the central opening 50, and therefore the central extension 96 assists in alignment of the voice coil support 46 during assembly of the speaker 10 (FIG. 1).

Figure 6A:
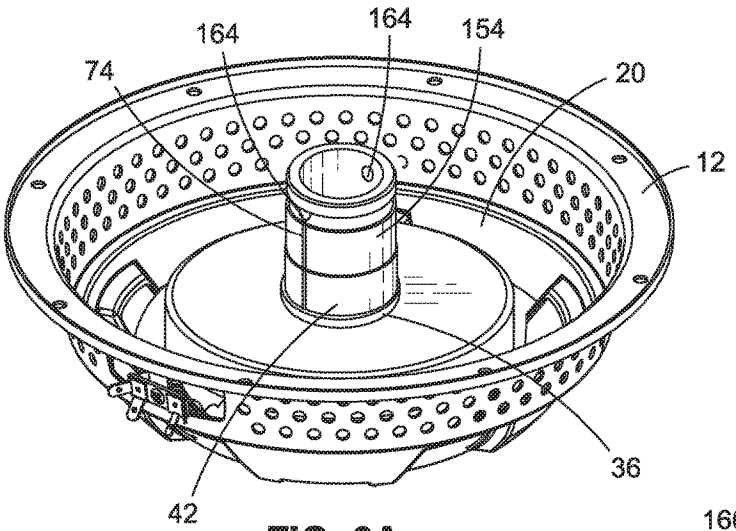
FIG. 6A is a perspective view of the fame and motor sub assembly with the voice coil, bobbin, and associated second alignment jig added.
Figure 6B:
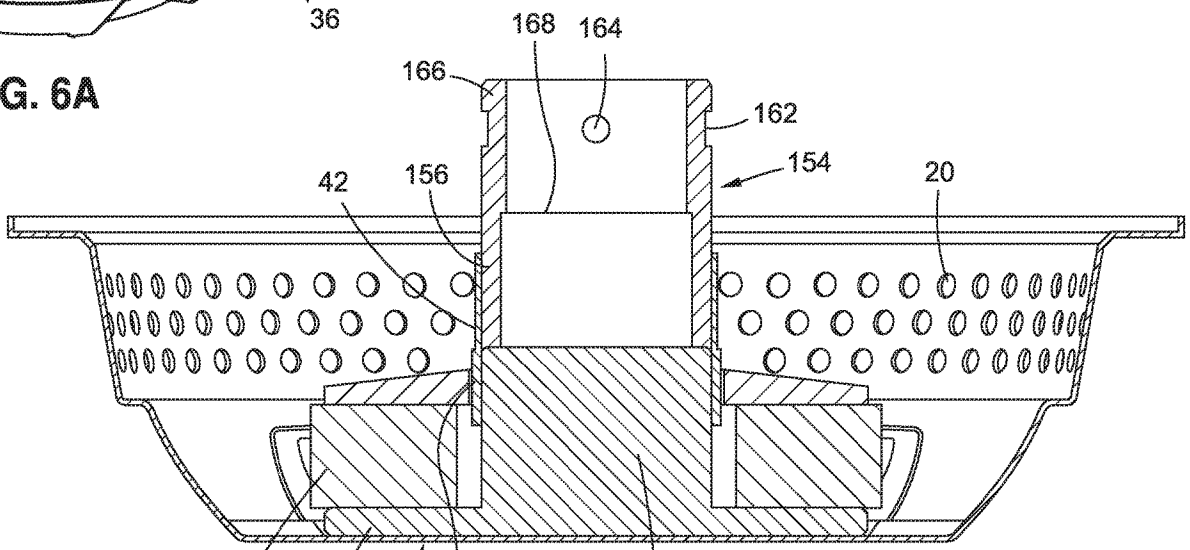
FIG. 6B is a side cross section view of the assembly of FIG. 6A.

The next step in manufacture, as shown in FIG. 6, is to remove the assembly of the edge support 52 (FIG. 5), spider 69 (FIG. 5), and the now attached voice coil support 46 (FIG. 5) from the interior 20 of the speaker frame 12. The first alignment jig 92 (FIG. 5) is also removed from the interior 20 of the speaker frame 12. As soon as the removals are completed, a second alignment jig 154 is placed in a bore 156 of the bobbin 42. The bobbin 42 also includes an outer surface 158, around which the voice coil 36 is wound.

The bobbin 42 and voice coil 36 are placed around the pole piece 32 of the motor 24, with the bobbin 42 next to the pole piece 32 and the voice coil 36 on the outer surface 158 of the bobbin 42. The pole piece 32 of the motor 24 is connected to the rear plate 30 and takes the charge of the portion of the magnet 26 in contact with the rear plate 30. The placement of the bobbin 42 on the pole piece 32 of the motor forms a central structure of the speaker 10 (FIG. 1).

The second alignment jig 154 may be placed in a bore 156 of the bobbin. The second alignment jig 154 is substantially cylindrical in shape. On an outer surface 160 of the second alignment jig is an annular groove 162. In the annular groove 162 or elsewhere on the outer surface 160 of the second alignment jig 154 may be at least one lead wire retention element 164, for example, a hole, a pin, or a slot, which extends through a depth of a wall 166 of the second alignment jig 154, from the outer surface 160 to an interior cavity 168 defined by the wall 166 of the second alignment jig 154. The at least one lead wire retention element 164 may be used to removably attach an end of a lead of the voice coil lead wire 74. This keeps the voice coil lead wires 74 from becoming entangled during assembly, as will be described in more detail below.

After the bobbin 42, voice coil 36 and second alignment jig 154 have been placed in the speaker, a band of adhesive may be applied around the circumference of the bobbin 42. The band of adhesive is located on the bobbin 42 to attach the voice coil support 46 (FIG. 1) to the bobbin 42, adhering central opening 50 of the voice coil support 46 to the bobbin 42.

Figure 7:
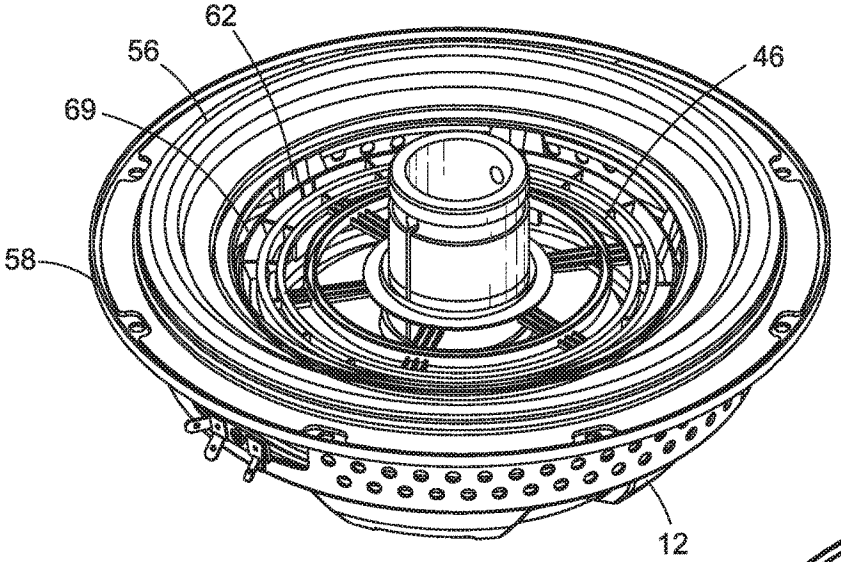
FIG. 7 is a perspective view of the of the speaker assembly, including the frame, motor, voice coil, bobbin, edge support, spider, and voice coil support with the second alignment jig in place.

With reference to FIGS. 1 and 7, after adhesive is also applied to the bobbin 42, adhesive may also be applied to the upper ledge 58 and lower ledge 72 of the frame 12. The assembly of the spider 69, edge support 52, and attached voice coil support 46, which were previously assembled in to a sub assembly, are placed back in the interior 20 (FIG. 6B) of the frame 12. When the sub assembly is placed back in to the frame 12, the outer circumference 70 of the spider 69 may be attached to the lower ledge 72 by the adhesive placed on the lower ledge 72. The outer perimeter 60 of the ring 56 may be attached to the upper ledge 58 by the adhesive placed on the upper ledge 58. The voice coil support 46 may be attached, via the band of adhesive applied to the bobbin 42, to the bobbin 42. In this way, the sub assembly of the edge support 52, spider 69 and voice coil support 46 may be attached in two places to the frame 12, and to the bobbin 42.

Figure 8A:
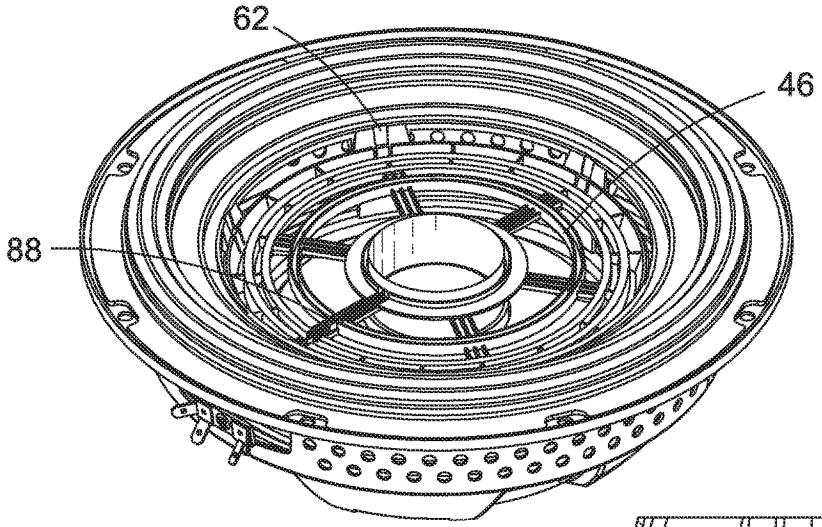
FIG. 8A is a perspective view of the same assembly as FIG. 7 with the second alignment jig removed.
Figure 8B:
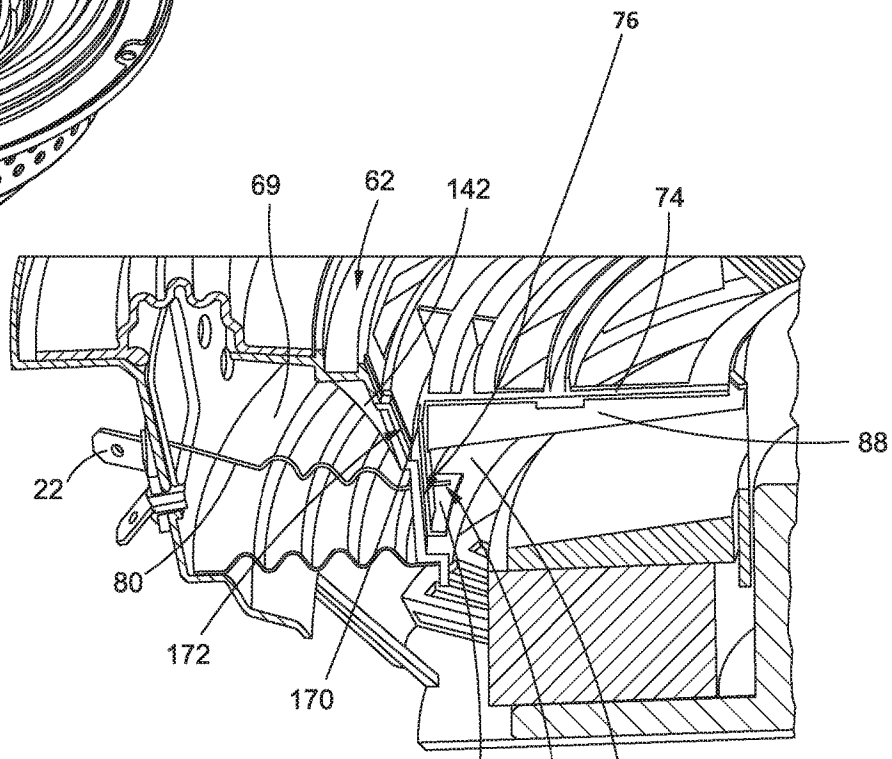
FIG. 8B is a detail view of the external connection terminal, lead wire, and pin connection.

With reference to FIGS. 7, 8A and 8B, the voice coil support 46 may include at least one unobstructed channel 88. During assembly, the at least one lead wire retention element 164 in the second alignment jig 154, the at least one unobstructed channel 88, the plurality of pins 76, and the external connection terminal 22 should be aligned. As shown in FIG. 8B, the voice coil lead wires 74 may be placed in the at least one unobstructed channel 88. The at least one unobstructed channel 88 terminates at a corresponding one of the plurality of pins 76. The plurality of pins 76 may have a vertical element 170 in addition to the horizontal element 78. The vertical element 170 may be attached to a linear element 142 of the rigid frame 62, and the horizontal element 78 may be attached to a rear aperture 66 of the rigid frame 62. The voice coil lead wire 74 may attach to a first end 172 of the pin on the vertical element 170 of the pin 76 by soldering, or may attach via mechanical means, such as placing the wire in a slot in the vertical element, or by wrapping the wire around an attachment screw placed in a threaded bore in the pin 76. Similarly, the external connection terminal lead wires 80 may extend from the external connection terminal 22, radially across the spider 69, where they may or may not be attached at various locations on the spider 69, and then may be attached to the horizontal element 78, which includes a second end 174, of the pin 76 by the methods described for attaching the voice coil lead wires 74 to the vertical elements 170 of the pins 76 as described above.

Figure 9:
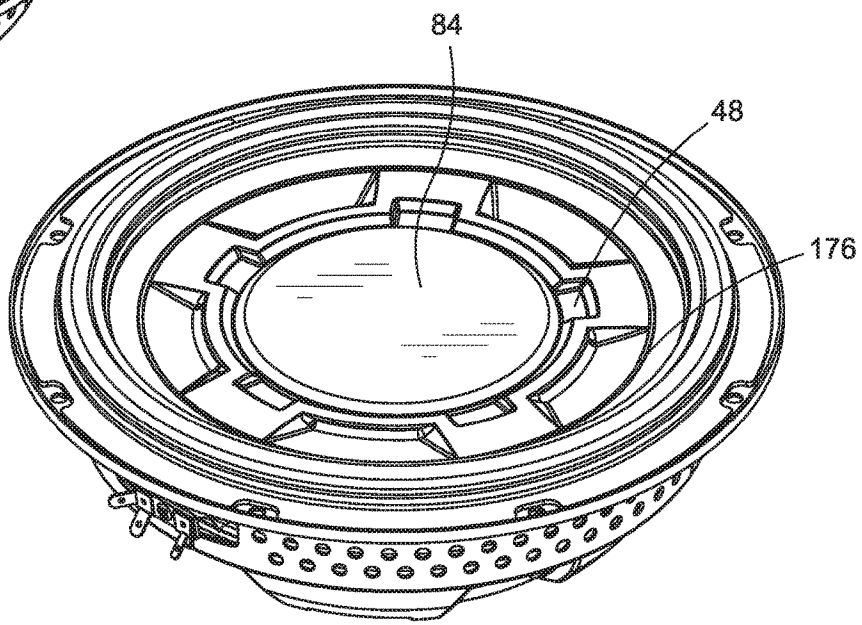
FIG. 9 is a perspective view of the assembled speaker.

With reference to FIGS. 1, 8A and 9, an adhesive may be applied to all forward or front facing surfaces of the voice coil support 46, and around an upper exposed surface of the rigid frame 62. The cone 48 then may be placed on the forward facing surfaces and the upper exposed surface to attach the cone 48 to the voice coil support 46 and, around an outer perimeter 176 of the cone 48, to the rigid frame 62. The dust cap 84 may attach to the cone 48 as shown in FIG. 1, or may attach to the voice coil support 46 or directly to bobbin 42. As shown in FIG. 1, the bobbin 42 attaches to the voice coil support 46. Thus, when the voice coil 36 moves the bobbin 42, the voice coil support 46 in turn moves the cone 48. The dust cap 84 may be attached to the cone 48 with adhesive or through a detent arrangement.

The above description is given by way of example, and not limitation. Given the above disclosure, one skilled in the art could devise variations that are within the scope and spirit of the invention disclosed herein, including various ways of connecting the speaker components. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A shallow speaker comprising:

a speaker frame defining an interior, the speaker including an external connection terminal, a lower flange, and an upper flange, the external connection terminal including a plurality of external connection terminal lead wires;

a speaker motor in the interior of the speaker frame, the speaker motor including a pole piece;

a bobbin abutting the pole piece;

a voice coil located around the bobbin, the voice coil including a plurality of voice coil lead wires;

a spider, including an inside edge and an outside edge, the outside edge attached to the lower flange of the speaker frame;

an edge support directly attached to the upper flange of the frame and the inside edge of the spider;

a voice coil support directly attached to the edge support and the bobbin, the voice coil support including channels, each channel sized and configured to accommodate one of the plurality of voice coil lead wires;

a plurality of pins, a portion of each one of the plurality of pins is located between the voice coil support and the edge support, each pin including a vertical element and a horizontal element, a first end being located on the vertical element, and a second end being located on the horizontal element, each one of the plurality of voice coil lead wires being attached to a corresponding first end of one of the plurality of pins, and each one of the plurality of external connection terminal lead wires being attached to a corresponding second end of one of the plurality of pins;

a cone connected to the voice coil support; and a dust cap connected to the cone.

2. The shallow speaker of claim 1, wherein an inner diameter of the cone is spaced apart from an outer diameter of the bobbin.

3. The shallow speaker of claim 1, wherein the plurality of external connector terminal lead wires are attached to the spider.

4. The shallow speaker of claim 1, wherein the bobbin extends through a central opening of the voice coil support.

5. The shallow speaker of claim 1, wherein the cone is attached to the edge support.

6. The shallow speaker of claim 1, wherein the cone is attached to an annular channel of the voice coil support.

7. The shallow speaker of claim 1, wherein each pin of the plurality of pins is attached a linear portion and a rear ring of the edge support.

* * * * *